US005238441A

United States Patent [19]

Llorens

[11] Patent Number: 5,238,441

[45] Date of Patent: Aug. 24, 1993

[54] ROLLER-SKATING DOLL

[75] Inventor: Jaime F. Llorens, Onil, Spain

[73] Assignee: Fabricas Agrupadas de Munecas de Onil S.A., Onil, Spain

[21] Appl. No.: 859,078

[22] Filed: Mar. 27, 1992

[30] Foreign Application Priority Data

Oct. 24, 1991 [ES] Spain ..... 9102367

[51] Int. Cl.[5] ..... A63H 11/00

[52] U.S. Cl. ..... 446/288; 446/355

[58] Field of Search ..... 446/288, 285, 286, 279, 446/294, 289, 291, 293, 355

[56] References Cited

U.S. PATENT DOCUMENTS 4,305,222 12/1981 Terzian et al. ..... 446/288
4,507,098 3/1985 Terzian et al. ..... 446/288
4,795,395 1/1989 Oishi et al. ..... 446/355 X
5,088,954 2/1992 Terzian et al. ..... 446/355

*Primary Examiner*—Mickey Yu
*Attorney, Agent, or Firm*—Helfgott & Karas

[57] ABSTRACT

A roller-skating doll includes a gear mechanism operated by an electric motor. The gear mechanism provides a revolving movement to a drum having a winding, ring-shaped groove containing two pins belonging to levers that actuate the legs of the doll. These levers are linked to two other levers, articulated in the middle, which convey the movement to the arms of the doll. There is also an eccentric on the outlet shaft of the drum in order to translate the movement to the head of the doll. The winding groove provided in the drum ensures that the movements of the legs, arms and head of the doll are synchronized. In addition, there is a device that causes the mechanism to stop for a moment and then to start again, as well as a clutch which allows the motor to idle in the event the doll would fall over if blocked by an obstacle.

6 Claims, 3 Drawing Sheets

ROLLER-SKATING DOLL

BACKGROUND OF THE INVENTION

This invention relates to a roller-skating doll to which a series of improvements have been provided to give a performance and movements to the dolls, that are a complete novelty as compared to current dolls that make roller-skating movements.

There are in fact skating dolls on the market, e.g., dolls that slide along pushing forward first one leg then the other, with these actions being accompanied by a head movement in order to achieve the balance that will prevent the doll from falling over as it slides along.

There are several problems and drawbacks with this type of doll, one of which is the fact that the sliding movement of the legs is a constant one. In other words, there are no pauses between the movements of one leg and the other, and so there is no complete or total similarity with real skating because when a person is skating there are pauses between the leg movements, that is, between the end of one leg thrust and the beginning of the next there is a break in the movements of the legs even though they continue skating.

Also, in the case of conventional skating dolls, if for any reason they lose their balance and fall over or are blocked by an obstacle or intentionally by the user, the whole mechanism continues working, with the possible burn-out of the motor.

It should likewise be pointed out that conventional skating dolls have no arm movements and so there is even less imitation of real skating.

SUMMARY OF THE INVENTION

An object of the invention is to provide the market and the public in general with a roller-skating doll which, on the basis of a series of new structural features, not only overcomes the problems or drawbacks of conventional dolls, but also provides the doll with a series of movements that are a true imitation of actual skating.

Indeed, in addition to moving its legs and head in order to skate along, the doll of the present invention also moves its arms in a totally synchronized way. In other words, each time a leg moves forward in a skating action, the head inclines towards that side and the respective arm is raised, all of which in a manner that exactly reproduces the real movements made by a person when roller-skating.

Apart from the synchronized head, leg and arm movements, the doll performs the sliding or skating movement, it stops a moment and starts skating again. It is being understood that "stop" means that the legs do not move although the doll continues to slide along.

Another novelty provided in the doll of the present invention is that it has a clutch mechanism which comes into operation when the doll falls over or is blocked by an obstacle, etc., in such a way that the clutch prevents power from being transmitted from the motor to the mechanism that actuates the legs, arms and head. This allows the motor to idle but prevents it from operating and possibly burning out as occurs with conventional dolls.

In order to achieve such a performance, the doll has been fitted with a mechanism which, on the basis of a gear operated by the motor, controls one or the other of the cog wheels fitted on the end of a drum through which the movements are transmitted to the legs by virtue of a ring-shaped winding groove provided in the drum. An appendage belonging to a lever linked to the respective leg moves inside the groove, in such a way that the forward and backward motions of the lever, as a result of the movements of the appendage inside the groove, bring about the leg thrust or movement which is synchronized with that of the other leg to produce alternate sliding actions, as the second leg is linked in just the same way as the first.

At the same time, the arms and head of the doll move in a synchronized way since each arm is linked to a lever, the end of which is connected to the lever that actuates the corresponding leg, while the head movements are caused by an eccentric integral with the actual drum shaft.

The drum's winding groove makes it possible for the movements to be synchronized, and so this drum may be given the name of "programming drum".

The pauses in movement are achieved due to the fact that one of the two wheels linked to the end of the programming drum has a sector without any cogs which causes the mechanism movement to stop, with this pause being the result of the other wheel integral with the drum immediately being taken up so that the drum will continue revolving. All of this is based on an axial movement of the pinions that engage with one or the other of the two wheels that operate the drum.

Furthermore, the drum includes a clutch device provided precisely by the drum's two cog wheels, a flexible disk inserted between them acting as a lining, and a compression spring that tends to push one wheel against the other.

In order to make it easier to understand the features of this invention, there follows a detailed description based on the drawings attached to this description, forming an integral part of the same, and in which the following has been depicted merely as a guide and in a non-restrictive way.

DETAILED DESCRIPTION OF THE PREFERRED EMBODIMENTS

Figure 1:
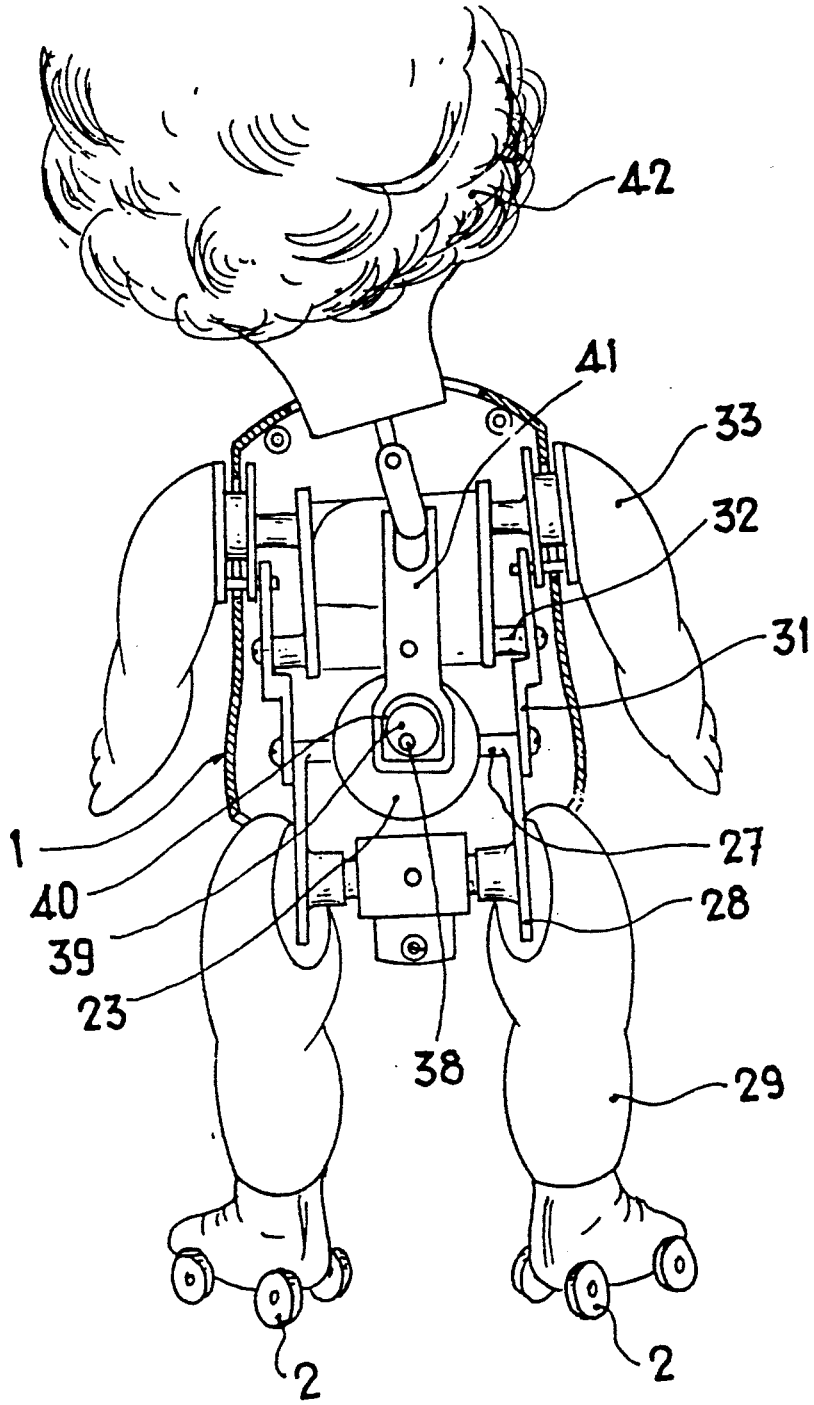
FIG. 1 shows a schematic perspective view of the skating doll of the present invention with the front part of the casing sectioned in order to show how the movements are transmitted to the legs, arms and head of the doll.

As can be seen from the drawings, the feet of the doll of the present invention, referred to in general with reference numeral (1), are fitted with their corresponding roller-skates (2), while all of the mechanism, which is powered by a battery-fed electric motor (3), is fitted inside the doll's body. By means of a pulley and belt transmission (4), the motor (3) causes a pinion (5) mounted on a shaft (6) to revolve, and on which in turn is fitted a grooved cylinder (7), independent of the pinion but integral with a cog wheel (8) as seen from FIGS. 2 and 3. This grooved cylinder (7) constitutes a cog cylinder on which wheels (9) and (10) are simultaneously engaged. These wheels are fitted on a shaft (11), and wheel (10) moves axially along the shaft (11) on which in turn are mounted a fitted wheel (12) which engages with the pinion (5), and a pinion (13) that engages with wheel (8). On the shaft (11) is also fitted a pinion (14), as well as a spring (15) that tends to constantly move wheel (10) towards wheel (9). The two wheels (9) and (10) ar provided, on their opposing faces, with respective projections (16) with complementary ramp-type edges, one of the wheels having one cog more than the other, which means that there is a different number of revolutions to each turn resulting in the ramps corresponding to the projections (16) becoming opposed and sliding together, thereby causing the wheel (10) to thrust against the spring (15) until reaching the maximum distance provided by the length of the projections (16), that is by their frontal opposition. Once this opposition has been passed over, the spring (15) thrusts the wheel (10) in the opposite direction, which brings the two wheels (9) and (10) back together in order for the cycle to start over again whilst the motor (3) is working.

On a shaft (17), parallel to shaft (11), is fitted another pinion (18) which, when wheel (10) comes close to wheel (9), engages with wheel (10). On the shaft (17) is fitted in turn a free-spinning pinion (19), as well as a second pinion (20) integral with the shaft (17), whose two pinions engage with wheels (21) and (22) provided on one of the ends of a programming drum (23).

The wheel (21) has a sector (24) without any cogs (FIG. 4), as well as a sector (25) with a smaller curvature diameter, thus forming a type of ramp so as to allow the pinion (19) to enter or engage once the cogless sector (24) is passed.

The programming drum (23) has a ring-shaped, winding or curvilinear groove (26) which contains, in diametrically opposed zones, two pins (27) each belonging to a lever (28) through which movement is transmitted to the legs (29) of the doll. Opposite the pin (27) for each lever (28) there is an articulation joint (30) of another lever (31) that rocks on an intermediate shaft (32), since the other end of the lever (31) is connected to the corresponding arm (33) of the doll.

Figure 6:
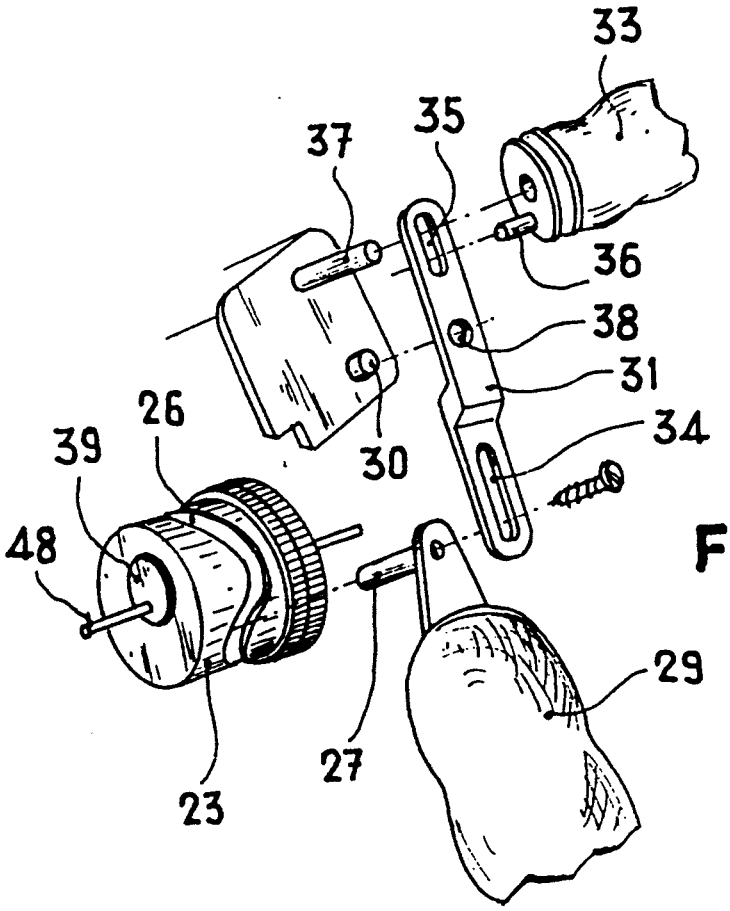
FIG. 6 shows an enlargement of the parts that make up the system whereby movement is transmitted to the arms.

The articulation joint (30) is made due to that end of the lever (31) being provided with a slide hole (34), whilst the articulation to the arm (33) of the doll is obtained by means of another slide hole (35) at the opposite end of lever (31) and which houses a pin (36) for the arm (33), as well as a pin (37) that functions as an assembly shaft for the arm itself (33), as can be seen in detail in FIG. 6 which also shows a hole (38) for the articulation joint (30) of this lever (31).

Figure 4:
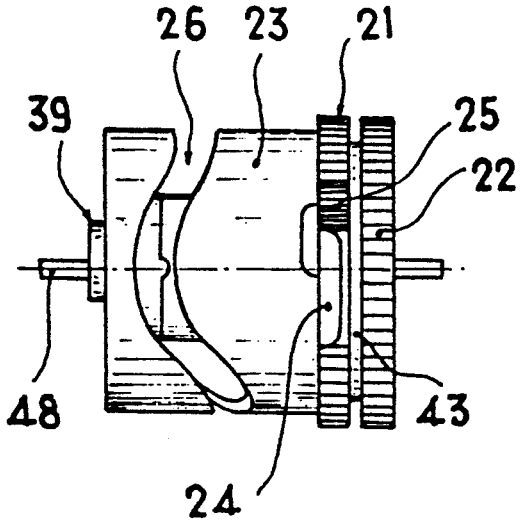
FIG. 4 shows a side elevation view of a programming drum.

On a shaft (48) of the programming drum (23), opposite the assembly end of the wheels (21) and (22), there is an eccentric (39), as seen in FIG. 4, playing in a rectangular window (40) of a lever (41), through which movement is transmitted to the head (42) of the doll.

The doll is also provided with an electric/electronic system which activates a musical device. This system may be brought into operation using a general switch and an auxiliary switch, in such a way that if the latter is not turned on, no sound or music will be produced, with the particular feature that a timer is fitted so that the sound or musical device works for a fixed time. In order to restart the sound the auxiliary switch must be turned on again.

The doll is designed to skate at a single speed, as well as to stop for a certain interval, always in a stable position on one leg. It has likewise been designed in such a way that the skating movements of the legs are synchronized and accompanied by movements of the respective arms and the head, all of which has been achieved on the basis of the structure described above.

Figure 2:
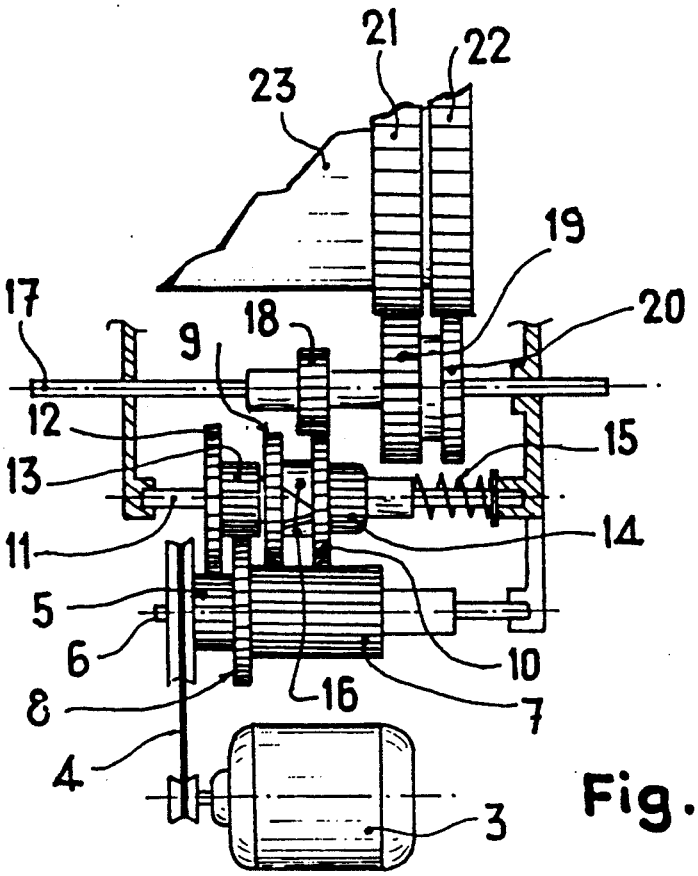
FIG. 2 shows a view of a gear mechanism when in the skating position.
Figure 3:
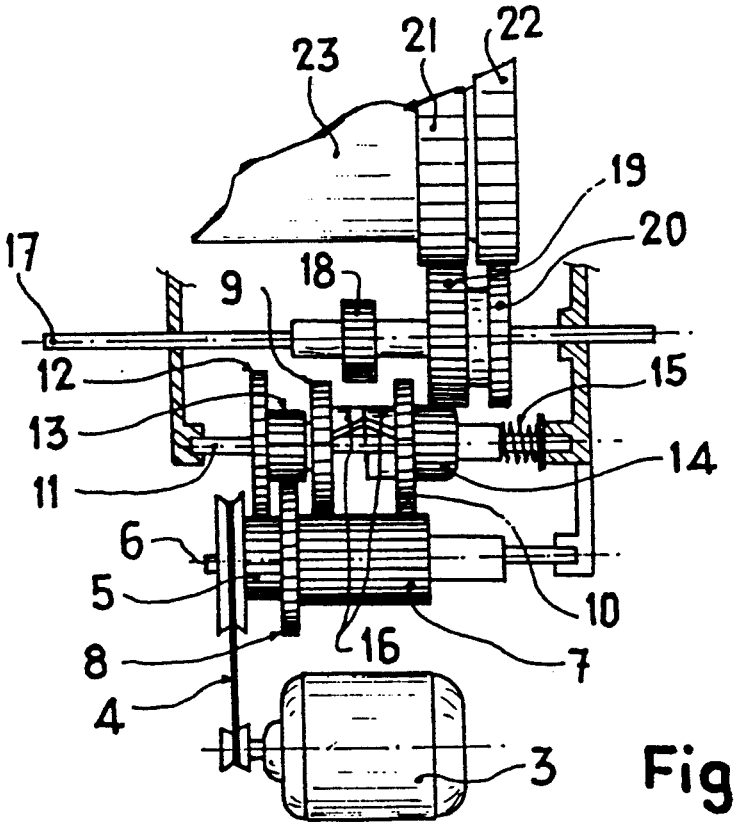
FIG. 3 shows the gear mechanism of FIG. 2 when in the stop position.

The system functions as follows:

Starting from the position depicted in FIG. 2, which is the skating position, the motor (3), through the transmission (4), causes the pinion (5) to turn and this affects the wheel (12) in such a way that, since the pinion (13) is integral with this wheel (12), engagement occurs with wheel (8) which causes the cog cylinder (7) to turn, thereby transmitting the revolving motion to the two wheels (9) and (10), in such a way that the latter affects the pinion (18), causing the shaft (17) to turn and therefore the pinion (20) which will engage with the wheel (22), causing the drum (23) to turn. The revolving motion of the drum will set the legs (29) moving alternatively on the basis of the layout and functional association of the respective levers (28). At the same time, the levers (31) that actuate the arms (33), and the lever (41) that makes the head (42) move are brought into motion, all of which is synchronized by virtue of the winding or curvilinear configuration of the groove (26) in the drum (23), and so the forward, skating movement of each leg is accompanied by the rhythmic movement of the arm on that side and by the sideway movement of the head, resulting in the body thrust for skating in the way it is actually done in practice.

Furthermore, the simultaneous turning of the wheels (9 and 10), due to their different number of cogs, causes the revolving motion of the projections (16) to be out of phase, with the ramp of each one of them sliding along that of its opposite member, thereby resulting in wheel (10) moving away from wheel (9), and the moment comes when the wheel (10) is disengaged from the pinion (18). However, the engagement occurs between the pinion (14) integral with the (10) and the idle pinion which, upon engaging with the wheel (21), would provide that the movement continues to be transmitted to the drum (23). Now, when this pinion (19) reaches the cogless sector (24), no engagement occurs and movement is halted until the pinion (10) engages once more with the pinion (18) resulting in drag and, therefore, transmission of the movement to the drum (23). At the same time, when the projections (16) of the wheels (9) and (10) reach the position of the greatest distance in the opposition, the moment comes when the opposing edges of these projections (16) no longer act as buffers and the wheel (10) is automatically moved, by means of the spring (15), towards the wheel (9), returning to the original position from which it started and repeating the cycle as long as the motor (3) is working.

Figure 5:
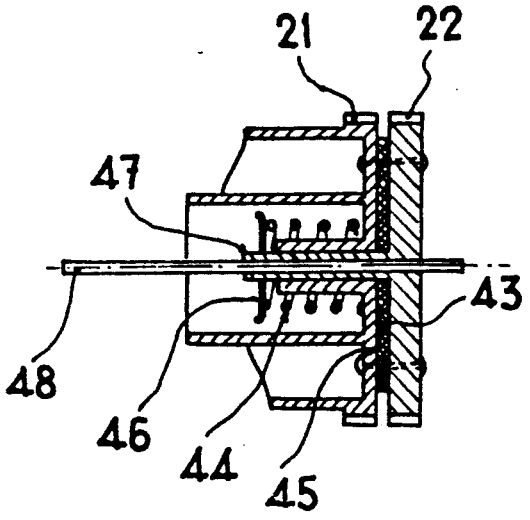
FIG. 5 shows a section view of the clutch device included in the programming drum.

Lastly, provision must be made of the clutch (shown in FIG. 5) included in the drum (23) for the purpose already referred to, namely to prevent the motor from continuing to work on load in the event of the doll falling over or colliding with an obstacle, etc. This clutch is made up of the drum (23) and the wheel (22) between which is placed a rubber disk or similar element (43), with the drum (23) and the wheel (22) being pushed towards their opposing positions, that is against the disk (43), by means of a spring (44) situated between the bottom of the base (45) of the drum, on the edge of which is fitted the wheel (21), and a washer (46) held in a socket (47) which encases the shaft (48) of the drum (23), this socket (47) being integral with the wheel (22).

I claim:

1. A roller-skating doll comprising a body; arms (33); legs (29) and a head (42); and a mechanism effecting movements of the doll to imitate skating, said mechanism including a motor (3), a gear mechanism operatively connected to said motor, a drum (23) operatively connected to and operated by said gear mechanism so as to revolve, two first levers (28) linked to said drum and connected to respective legs of the doll to transmit movements from said drum to said legs which perform skating movements, a second lever (41) operatively connected to said drum (23) and to the head (42) of the doll to actuate said head so that said head moves from side to side in synchronism with the movements of the legs, said gear mechanism including a first shaft (17) operatively connected to said motor, a pair of coaxial pinions (19, 20) mounted on said first shaft (17) with one of said pinions (19) being free-spinning, two first wheels (21, 22) fitted at one end of said drum (23) and each engaging a respective one of said coaxial pinions, said first levers (28) including first pins (27), said drum (23) including a ring-shaped winding groove (26) receiving said first pins (27), two third levers (31) operatively connected to said first levers (28) and to the arms (33) of the doll to transmit movements to said arms such that the movements of the arms are synchronized with the movements of the legs, said drum being provided with an eccentric (39) fitted at another end thereof and operatively connected to said second lever (41) so as to synchronize movements of the head (42) with the movements of the legs and the arms, one of said first wheels (21) including a cogless sector (24) which causes said mechanism to stop for a moment after which operation of the mechanism restarts.

2. A roller-skating doll of claim 1, wherein said gear mechanism further includes a second shaft (6) connected to said motor (3) to be rotated thereby, a first pinion (5) mounted on said second shaft (6) and rotatably by said motor (3), a cog cylinder (7) and a cog wheel (8) freely mounted on said second shaft (6) and being integral with each other, a third shaft (11) carrying thereon a wheel (12) engaged with said first pinion (5) and a second pinion (13) integral with said wheel (12) and engaged with said cog wheel (8) to translate movement to said cog cylinder and said cog wheel, two second wheels (9, 10) mounted on said third shaft (11) and engaged with said cog cylinder (7), a coil spring (15) provided on said third shaft, one of said second wheels (10) being axially movable along said third shaft against action of said coil spring so that said coil spring tends to push said one of said second wheels (10) towards another of said wheels (9), said two second wheels (9, 10) having a different number of cogs thereon and being provided at opposing end faces thereof with ramped projections (16) formed to engage with each other and slide against each other so as to cause said two second wheels (9, 10) to separate from each other due to a different number of cogs, a third pinion (18) mounted on said first shaft (17), a fourth pinion (14) integral with said one of said second wheels (10), said one of said second wheels (10), upon an axial movement thereof towards said another of said second wheels (9) along said third shaft (11), engaging said third pinion (18) so as to transmit movement to said drum (23) via said first shaft (17), one of said coaxial pinions (20) and another of said first two wheels (22), and, upon the axial movement of said one of said second wheels (10) in a direction away from said another of said second wheels (9) and when a maximal distance therebetween is obtained, provided by sliding of said ramped projections (16), said one of said second wheels (10) disengaging from said third pinion (18) on said first shaft (17) and said fourth pinion (14) engaging with another (19) of said coaxial pinions which is engaged with said one of said first wheels (21) so as to stop the gear mechanism.

3. A roller-skating doll of claim 2, wherein said one of said first wheels (21) has at an end thereof provided with said cogless sector (24), a ramp portion which allows said another of said coaxial pinions (19) to come into engagement with said one of said first wheels once said cogless sector (24) has been passed during rotation of said coaxial pinions.

4. A roller-skating doll of claim 2, wherein each of said third levers (31) for actuating the arms has at one end thereof a first slide hole (34) receiving means for connecting each of said third levers (31) to the respective first levers (28), said arms including second pins (36), each of said third levers further having at another end thereof a second slide hole (35) receiving a respective one of said second pins, and further comprising third pins (37) received in said arms for connecting said arms to said third levers (31).

5. A roller-skating doll of claim 2, and further comprising a clutch mechanism provided in said drum (23) to prevent said motor (3) from operating when unnecessary, said clutch mechanism including a rubber disk (43) positioned between end faces of said two first wheels (21, 22), a washer (46) fixed to said another of said two first wheels (22) via a socket (47) positioned in said drum (23), and a spring (44) positioned between a base (45) of said drum (23) carrying said one of said two first wheels (21) and said washer (46), said spring (44) pressing said drum (23) and said another of said first two wheels (22) against said disk (43).

6. A roller-skating doll of claim 1; and further comprising an auxiliary switch fitted with an electronic timer and operating as a sound device.

* * * * *